United States Patent [19]

Kelly

[11] Patent Number: 4,848,056

[45] Date of Patent: Jul. 18, 1989

[54] HOLE REPAIRING DEVICE

[76] Inventor: Larry J. Kelly, 420 North 17th Crt., Estherville, Iowa 51334

[21] Appl. No.: 298,627

[22] Filed: Jan. 18, 1989

[51] Int. Cl.[4] ..... E02D 37/00

[52] U.S. Cl. ..... 52/514; 52/98

[58] Field of Search ..... 52/514, 98

[56] References Cited

U.S. PATENT DOCUMENTS

| | | | |
|---|---|---|---|
| 3,325,955 | 6/1967 | Haut | 52/514 |
| 4,075,809 | 2/1978 | Sirkin | 52/514 |
| 4,100,712 | 7/1978 | Hyman | 52/514 |
| 4,285,183 | 8/1981 | Condit | 52/514 |
| 4,406,107 | 9/1983 | Schoonbeck | 52/514 |

*Primary Examiner*—David A. Scherbel

*Assistant Examiner*—Creighton Smith

*Attorney, Agent, or Firm*—H. Jay Spiegel

[57] ABSTRACT

The present invention relates to a device designed to be used in repairing a hole in a wall, door, or other structure. The device includes a male member threaded into a recess in a female member with an umbrella-shaped device mounted on the male member and initially stored within a recess in the female member but released therefrom when the male member is unthreaded from the female member whereupon the umbrella device spreads outwardly to cover or obscure the opening. Break points are formed on the male member to allow the shaft thereof to be broken off after the device is properly positioned.

7 Claims, 1 Drawing Sheet

HOLE REPAIRING DEVICE

BACKGROUND OF THE INVENTION

The present invention relates to a hole repairing device. In the prior art, devices designed to be used to repair holes are known. However, applicant is unaware of any device which is constructed and used in the same manner as the present invention. The following prior art is known to applicant:

U.S. Pat. No. 4,075,809 to Sirkin discloses a hole repair device including an elongated threaded shaft on which is mounted an umbrella device, with the shaft having a point at its end. The present invention differs from the teachings of this patent as including a male member threaded into a female member on which a point is provided.

U.S. Pat. No. 4,100,712 to Hyman discloses a hole repair kit including a spreadable support plate and a pivoting wing member, both of which are mounted on a threaded element. This differs from the present invention, since the present invention includes a male threaded element threaded into a female element which stores the umbrella device when not in use.

U.S. Pat. No. 4,285,183 to Condit teaches the concept of a wall board patching apparatus including a hole covering member attached to a wire device which may be used to support the hole covering member from outside the wall. This differs from the teachings of the present invention wherein support for the hole covering device is completely internal of the wall.

SUMMARY OF THE INVENTION

The present invention relates to a hole repairing device, and includes the following interrelated aspects and features:

(a) In a first aspect, the inventive device includes a threaded male member threadably received within a threaded opening of a female member.

(b) The female member includes an end distal from the male member which is pointed to allow engagement with an adjacent surface. At a proximal end of the female member, a recess of greater diameter than the above-described threaded opening is provided.

(c) Attached to the male member is an umbrella device made of a flexible material and which, when the threaded male member is completely threaded into the threaded opening of the female member, is contained within the recess of the female member and stored therein.

(d) The male member has a handle at its proximal end allowing rotation of the male member with respect to the female member and the elongated threaded shaft of the male member has break points closely-spaced throughout its length to allow the male member to be broken off at a convenient location after the device has been installed in its desired location.

Accordingly, it is a first object of the present invention to provide a hole repairing device.

It is a further object of the present invention to provide such a hole repairing device including a female member into which is threaded a male member which carries an umbrella device.

It is a yet further object of the present invention to provide such a device wherein the male member has an elongated threaded shaft having break points throughout its length.

These and other objects, aspects and features will be better understood from the following detailed description of the preferred embodiment when read in conjunction with the appended drawing figures.

SPECIFIC DESCRIPTION OF THE PREFERRED EMBODIMENT

Figure 1:
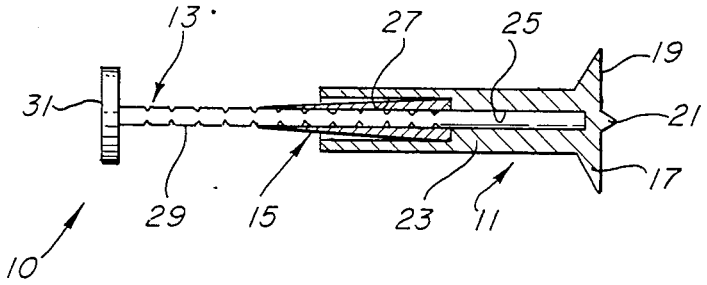
FIG. 1 shows a cross-sectional view through the preferred embodiment of the present invention.

With reference, first, to FIG. 1, the hole repairing device is generally designated by the reference numeral 10 and is seen to include a female member 11 and a male member 13 as well as an umbrella device 15.

The female member 11 includes a base 17 having a distal face 19 with a pointed member protruding centrally therefrom. Proximal of the base 17 is an elongated portion 23 having an internal threaded opening 25 and, proximally thereof, an elongated recess 27 of a diameter larger than the diameter of the elongated threaded opening 25.

The threads of the opening 25 are complimentary to the threads on an elongated shaft 29 of the male member 13. A proximal end of the shaft 29 includes a handle 31 designed to be gripped by the user to allow threading of the male member 13 into and out of the elongated threaded opening 25 of the female member 11.

Figure 2:
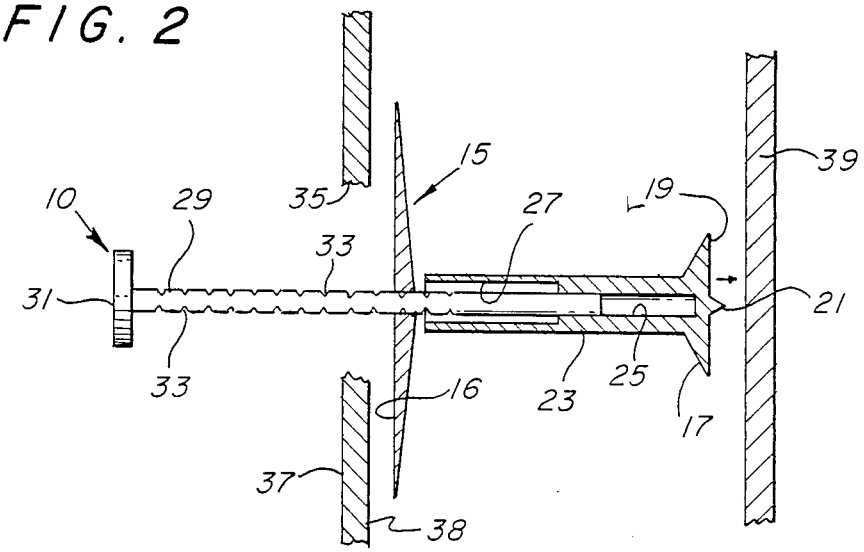
FIG. 2 shows a cross-sectional view through the device illustrated in FIG. 1 but in a different orientation thereof and within a wall or door where a hole repair is to be undertaken.

With reference, now, to FIG. 2, it is seen that the umbrella device 15 is flexible enough to allow retention within the recess 27 of the female member 11 as seen in FIG. 1, yet will spread outwardly when released from the recess 27. The umbrella device is rigidly fixed to the male member 13 and is constrained to move therewith.

As best seen in FIG. 2, the elongated threaded shaft 29 includes break points 33 at closely-spaced positions throughout its length for a purpose to be described in greater detail hereinafter.

FIG. 2 shows the inventive device 10 as it would be used to repair a hole 35 in a wall 37 which has closely adjacent thereto another wall 39. Such a situation may occur in wall board as well as a door wherein the walls 37 and 39 could be the outer surfaces of the door.

In the operation of the present invention, with the elongated threaded shaft 29 completely threaded into the recess 25 as seen in FIG. 1, with the umbrella device 15 retained within the recess 27, the device 10 may be inserted through the opening 35 and to a position where the pointed member 21 engages the wall 39. A device such as a hammer may be used to strike the center of the handle 31 to drive the pointed member 21 into the wall 39. In the preferred embodiment of the present invention, the pointed member 21 is of non-circular cross-section so that when the pointed member 21 is driven into the wall 39, its outer configuration will resist rotation of the female member 11 responsive to rotations of the threaded member 13 with respect thereto.

After the pointed member 21 has been forced into the wall 39, the handle 31 may be rotated to unthread the elongated threaded male member 29 from the threaded opening 25. Such unthreading will release the umbrella device 15 from the recess 27 whereupon the umbrella device will spring open to the configuration shown in FIG. 2. Further unthreading of the male elongated threaded shaft 29 will result in engagement of the surface 16 of the umbrella device 15 with the surface 38 of the wall 37. In such position, with the device 10 firmly in place, the male shaft 29 may be broken at one of the break points 33, preferably within the opening 35, so that no portion of the shaft 29 protrudes proximally of the opening 35 and wall 37. Thereafter, the hole 35 may easily be filled by suitable putty or other material.

In the preferred embodiment of the present invention, the umbrella device 15 is of substantially circular shape. However, any suitable shape for the umbrella device 15 may be used, such as square, oblong, elliptical, rectangular, or any other desired shape. Furthermore, the umbrella device may be made of any desired outer diameter or dimension. If desired, when the umbrella device is made of large dimensions, the female member 11 may be elongated to provide a larger recess 27 to accommodate the umbrella device 15 therein. In reality, however, the recess 27 only need be sufficiently deep enough to cause the umbrella device 15 to collapse and lie closely adjacent the shaft 29 when the device 10 is in the position shown in FIG. 1.

The umbrella device may be made of any desired materials such as, for example, rubber, paper, cardboard, flexible plastic, or the like. The members 11 and 13 are preferably made of metal although they may be made of wood, plastic or any other suitable material.

As such, an invention has been disclosed in terms of a preferred embodiment thereof which fulfills each and every one of the objects of the invention as set forth hereinabove and provides a new and improved hole repairing device which is, quite effective in use.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A hole repairing device, comprising:

(a) a female member having a distal pointed end, a threaded opening proximal of said distal pointed end and an enlarged recess proximal of said opening;

(b) a male member having an elongated threaded shaft threadably received in said threaded opening and a flexible umbrella device mounted on said shaft and collapsibly receivable within said recess when said shaft is threaded in said opening;

(c) said device being adapted to repair a hole in a first wall having a second wall closely adjacent thereto with said pointed end engaging said second wall and said umbrella device released from said recess and covering said hole and engaging a surface of said first wall facing said second wall.

2. The invention of claim 1, wherein said female member includes a base from which said pointed end protrudes, said pointed end including a point of non-circular cross-section.

3. The invention of claim 1, wherein said elongated threaded shaft has a plurality of break points spaced throughout the length thereof.

4. The invention of claim 1, wherein said male member includes a proximal handle adapted to be gripped by the user thereof.

5. The invention of claim 1, wherein said umbrella device is made of rubber.

6. The invention of claim 1, wherein said umbrella device is made of paper.

7. The invention of claim 1, wherein said umbrella device is of circular shape.

* * * * *